US012258183B2

(12) United States Patent
van Meurs et al.

(10) Patent No.: US 12,258,183 B2
(45) Date of Patent: Mar. 25, 2025

(54) CLOSURE WITH BONDED TAMPER EVIDENCE

(71) Applicant: Weener Plastics Group B.V., Ede (NL)

(72) Inventors: Dennis Antonius Wilhelmus Maria van Meurs, 's-Hertogenbosch (NL); Antonetta Johanna Maria Schoenmakers, Udenhout (NL)

(73) Assignee: Weener Plastics Group B.V., Ede (NL)

( * ) Notice: Subject to any disclaimer, the term of this patent is extended or adjusted under 35 U.S.C. 154(b) by 204 days.

(21) Appl. No.: 17/613,551

(22) PCT Filed: May 29, 2020

(86) PCT No.: PCT/EP2020/065060
§ 371 (c)(1),
(2) Date: Nov. 23, 2021

(87) PCT Pub. No.: WO2020/245062
PCT Pub. Date: Dec. 10, 2020

(65) Prior Publication Data

US 2022/0242623 A1 Aug. 4, 2022

(30) Foreign Application Priority Data

Jun. 3, 2019 (NL) ..... 2023251

(51) Int. Cl.
*B65D 43/16* (2006.01)
*B65D 51/24* (2006.01)
*B65D 55/02* (2006.01)

(52) U.S. Cl.
CPC ..... *B65D 43/169* (2013.01); *B65D 51/246* (2013.01); *B65D 55/024* (2013.01);
(Continued)

(58) Field of Classification Search
CPC ..... B65D 43/169; B65D 55/024; B65D 2401/15; B65D 2251/105
(Continued)

(56) References Cited

U.S. PATENT DOCUMENTS 4,640,427 A 2/1987 Marino et al.
5,147,054 A * 9/1992 Pehr ..... B65D 51/20 215/253

(Continued)

FOREIGN PATENT DOCUMENTS

DE 295 09 062 U1 9/1996
EP 0 773 172 B1 7/2000

(Continued)

OTHER PUBLICATIONS

European Patent Application No. 20 728 505.7, Communication pursuant to Article 94(3) EPC, dated Jul. 10, 2024, 8 pages.

*Primary Examiner* — James N Smalley
(74) *Attorney, Agent, or Firm* — Hoffmann & Baron, LLP

(57) ABSTRACT

A closure for a container includes an annular base to be fixed to the upper rim of a container and a lid. The lid is adapted to be moved to an open position, in which access is gained to the container. A locking member is attached to the base and to the lid so as to lock the lid relative to the base such that movement of the lid relative to the annular base is prevented. The locking member includes at least one tamper-evident lug welded to an attachment surface of the lid or the annular base and a frangible connection integrally adjoining the tamper-evident lug.

25 Claims, 6 Drawing Sheets

(52) U.S. Cl.
CPC ..... *B65D 2251/105* (2013.01); *B65D 2251/1058* (2013.01); *B65D 2401/15* (2020.05)

(58) Field of Classification Search
USPC ..... 220/254.3
See application file for complete search history.

(56) References Cited

U.S. PATENT DOCUMENTS

| | | | | |
|---|---|---|---|---|
| 5,219,087 | A | 6/1993 | Christensson | |
| 5,810,188 | A * | 9/1998 | Novakoski | B65D 43/169 215/237 |
| 9,387,962 | B2 * | 7/2016 | Mercado | A47G 19/06 |
| 9,930,996 | B2 * | 4/2018 | Wiggins | B65D 43/22 |
| 11,192,688 | B2 * | 12/2021 | Herlin | B65D 43/169 |
| 11,697,528 | B2 * | 7/2023 | Dahlin | B65D 51/18 220/254.1 |
| 2010/0264156 | A1 * | 10/2010 | VanDamme | B65D 43/162 220/833 |
| 2010/0308044 | A1 | 12/2010 | Perry et al. | |
| 2015/0210450 | A1 | 7/2015 | Mercado et al. | |
| 2016/0000268 | A1 | 1/2016 | Wiggins et al. | |
| 2016/0000270 | A1 | 1/2016 | Wiggins et al. | |
| 2016/0264316 | A1 * | 9/2016 | Quinn | B65D 55/024 |

FOREIGN PATENT DOCUMENTS

| | | | | |
|---|---|---|---|---|
| EP | 3 100 962 | A1 | 7/2016 | |
| EP | 4147989 | A1 * | 3/2023 | |
| FR | 1 278 499 | A | 12/1961 | |
| GB | 2161463 | A * | 1/1986 | B65D 41/3495 |
| GB | 2 366 790 | A | 3/2002 | |
| WO | 00/76875 | A1 | 12/2000 | |
| WO | 2016/072912 | A1 | 5/2016 | |
| WO | 2017/204731 | A1 | 11/2017 | |

* cited by examiner

CLOSURE WITH BONDED TAMPER EVIDENCE

CROSS-REFERENCE TO RELATED APPLICATIONS

This application is the National Stage of International Application No. PCT/EP2020/065060, filed May 29, 2020, which claims the benefit of Netherlands Application No. 2023251, filed Jun. 3, 2019, the contents of which is incorporated by reference herein.

FIELD OF THE INVENTION

The invention relates to a closure for a container, wherein said container has an open top side defined by an upper rim surrounding said open top side. The closure comprises an annular base to be fixed to the upper rim of the container and defining an access opening to the container. The closure further comprises a lid adapted to cover the access opening in a closed position. The lid is adapted to be moved to an open position, in which the access opening is unblocked by the lid. A locking member is attached to the annular base and to the lid so as to lock the lid relative to the base such that movement of the lid relative to the annular base is prevented.

BACKGROUND OF THE INVENTION

A closure of this type is disclosed in WO 2016/072912. In this known closure the lid is hingedly connected to the annular base. The locking member is constituted by a locking tab that is hingedly connected to the annular base. Furthermore the locking tab is connected by a tamper-evident arrangement between the lateral edges of the locking tab and the annular base in the form of two breakable connections. The most feasible breakable connection comprises small breakable connection portions which are integrally formed between the lateral edges of the locking tab and the annular base during injection moulding, because such connection portions can be dimensioned in a well-defined manner and thus require a well-defined opening force to be broken. A disadvantage of integrally moulding the breakable connection portions is that the locking tab is necessarily moulded in the locking position and the lid, which is formed separately from the annular base, or is formed in an open state, has to exercise a force on the locking tab to close the lid for the first time and bring about the snap connection between the lid and the locking tab. This may compromise the breakable connection portions.

A similar problem may occur with a closure disclosed in U.S. Pat. No. 5,219,087. This document shows in FIGS. 7 and 8 a closure having an annular base and a hinging lid formed in one piece. The lid includes a locking member formed as a gripping tongue having a projecting hook to releasably lock the lid and the annular base in a closed position of the lid. A tamper-evident tear tab is connected to the annular base by a weakened hinge. The annular base and the lid are moulded in an open state. When the closure is closed for the first time the tear tab is hinged over the gripping tongue. Next the tear tab is welded to the lid by one or several easily breaking welding points. When the lid is opened for the first time the tear tab is removed by breaking the welding points and tearing off the tear tab along the weakened hinges. This known closure has the disadvantage that after first time opening the tear tab becomes a loose part which may get lost.

In the field of this type of closures also a lot of designs are known in which a locking tab does not only engage a front surface of the lid, but also reaches over the edge between the deck of the lid and the skirt of the lid. Examples of these closures are shown in EP 773172B1, US 2015/0210450 A1, US 2016/0000270 A1, US 2016/0000268 A1 and WO 2017/204731. These closures cannot be formed with the locking tab in a locking state because after forming the annular base and the lid, the lid could be closed. Therefore, in these closure designs, well-defined integrally injection moulded connection portions between the locking tab and the annular base, as is disclosed in WO 2016/072912, are not an option. WO 2016/072912 also mentions glue dots and welding as ways to form the breakable connections. However, in practise it is difficult to form well-defined breakable connections by glue dots or by welding.

The invention has for an object to provide an alternative closure.

SUMMARY OF THE INVENTION

This object is achieved by a closure for a container, wherein said container has an open top side defined by an upper rim surrounding said open top side,

- the closure comprising an annular base to be fixed to the upper rim of the container and defining an access opening to the container, and the closure further comprising a lid adapted to cover the access opening in a closed position, the lid adapted to be moved to an open position, in which the access opening is unblocked by the lid,
- wherein a locking member is attached to the base and to the lid so as to lock the lid relative to the base such that movement of the lid relative to the annular base is prevented,
- wherein the locking member comprises at least one tamper-evident lug welded to an attachment surface of the lid or the annular base, and a frangible connection integrally adjoining the tamper-evident lug.

In the closure according to the invention the locking member comprises a tamper-evident lug, which is welded to the lid or the annular base, and which is released from the other one of the annular base and the lid at a first time opening of the closure when the frangible connection is broken. The broken frangible connection is clearly visible and the tamper-evident lug remains fixed to the lid or the annular base such that no loose parts are created when the closure is opened for the first time.

The closure according to the invention can be manufactured by a method in which the annular base, the lid and the locking member, comprising the tamper-evident lug, are each injection moulded from a plastic material. After injection moulding, the lid is positioned in a closed state on the annular base and the locking member is positioned in a locked state, such that the tamper evident lug faces the attachment surface. Finally, the tamper-evident lug is attached to the attachment surface of the lid or, alternatively, the annular base by an ultrasonic welding tool and weld it to the attachment surface.

The annular base, the lid and the locking member may be injection moulded in one piece, in which case the lid and the annular base are formed in an open state with a living hinge between them. The locking member and the annular base, or alternatively the locking member and the lid, are formed in an unlocked state one piece. After ejection from the mould the lid can be brought to a closed position on the annular base and next the locking member can be brought to a locked state in which the connection between the locking member and the lid or the annular base is brought about.

In a preferred embodiment of the closure according to the invention the lid is attached to the annular base by a hinge such that the lid can be pivotally moved between a closed position, in which the lid covers the access opening, and an open position, in which the access opening is unblocked by the lid.

In a preferred embodiment the locking member comprises a locking tab integral with the annular base or the lid, wherein the tamper-evident lug is integrally formed with the locking tab, and wherein the frangible connection is formed between the locking tab and the tamper-evident lug. In the embodiment the locking tab is adapted to lock the lid with respect to the annular base also when the frangible connection of the tamper-evident lug is broken. Preferably the locking tab and the lid are adapted to form a releasable snap connection so as to lock the lid relative to the base in a locked state. In this embodiment the locking tab preferably has a latch member which engages behind a latching rim of the lid or of the annular base to form the snap connection.

In a further preferred embodiment of the closure according to the invention the locking tab is integrally formed with the annular base or with the lid.

Preferably the locking tab is hingedly connected to the annular base or the lid.

In a further embodiment the lid has a deck and an outer skirt depending from the deck, the deck including an indent which is recessed with respect to an upper deck surface, wherein the indent is adapted to provide space for a finger to engage the locking tab so as to release the snap connection.

Preferably the indent is adjacent to the attachment surface of the lid. Thereby the user can engage and pull the locking tab upwards close to the frangible connection between the locking tab and the tamper-evident lug. This facilitates rupturing of the frangible connection.

In a possible embodiment the locking tab has a first portion, which in the locked state lies flush with the outer skirt of the lid and with an outer circumferential surface of the annular base, and wherein the locking tab has a second portion which in the locked state lies flush with the upper deck surface.

In a possible embodiment the deck of the lid has a recessed area to receive the tamper-evident lug. Preferably the recessed area is configured such that the tamper-evident lug in the locked state lies flush with the upper deck surface, and preferably the recessed area has a contour corresponding with an outer contour of the tamper-evident lug. Thereby only a minor gap is present between the outer contour of the tamper-evident lug and the inner contour of the recessed area, which has the effect that the tamper-evident lug is not reachable with a finger or a tool and cannot be detached from the attachment surface.

In a possible embodiment the second portion of the locking tab has a gripping edge which in the locked state is facing the indent, wherein the frangible connection between the locking tab and the tamper-evident lug is in line with said gripping edge.

Another aspect of the invention relates to a closure for a container, wherein said container has an open top side defined by an upper rim surrounding said open top side. The closure comprises an annular base to be fixed to the upper rim of the container and defining an access opening to the container, and the closure further comprises a lid adapted to cover the access opening in a closed position. The lid is adapted to be moved to an open position, in which the access opening is unblocked by the lid. A locking member is attached to the base and to the lid so as to lock the lid relative to the base such that movement of the lid relative to the annular base is prevented. The closure furthermore comprises at least one tamper-evident lug welded to an attachment surface of one of the annular base and the lid, and a frangible connection integrally connecting the tamper-evident lug to the other one of the annular base and the lid.

The invention will be further elucidated in the following description of possible embodiments with reference to the drawings.

DETAILED DESCRIPTION OF THE INVENTION

Figure 1:
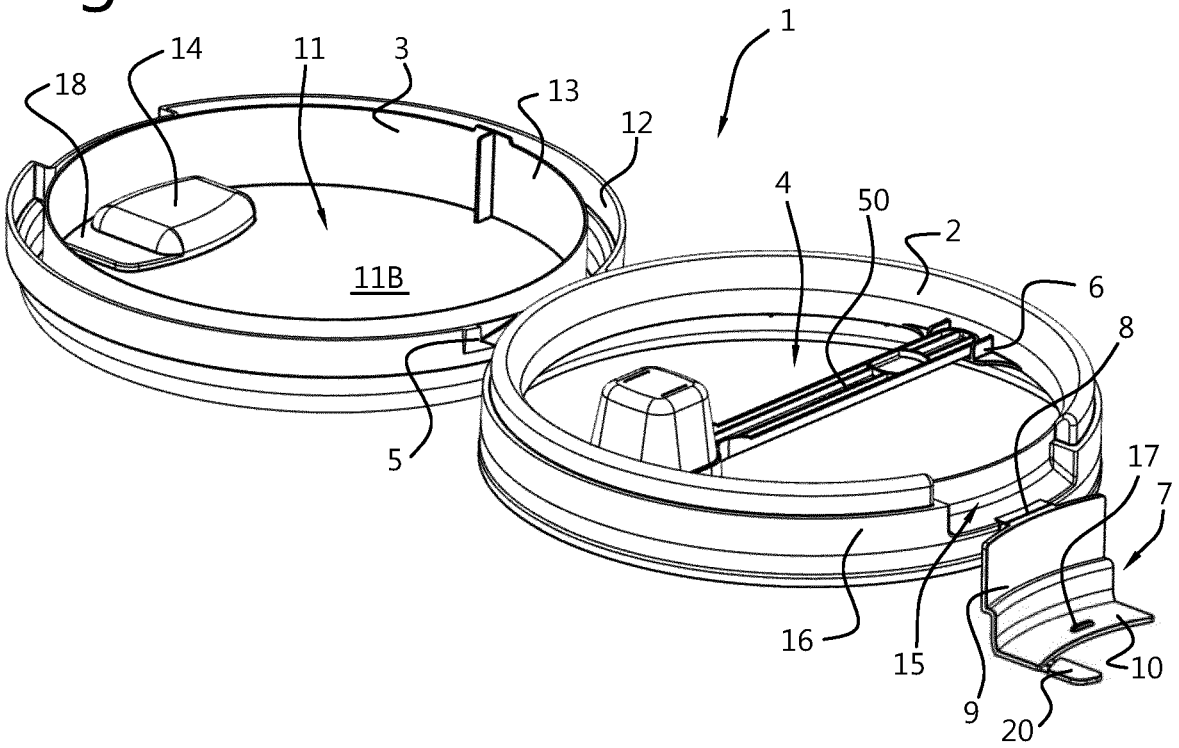
FIG. 1 shows a view in perspective of a possible embodiment of a closure according to the invention in an open state before the first time closure.
Figure 2:
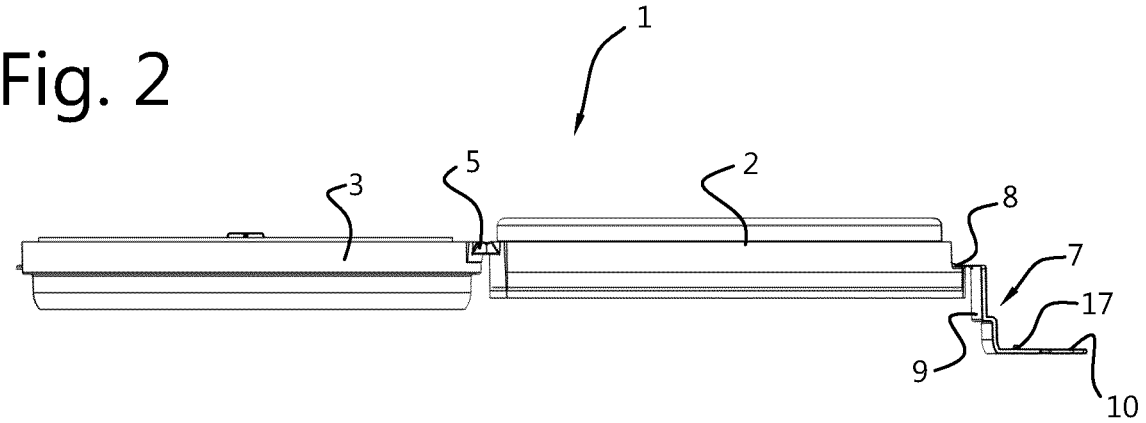
FIG. 2 shows a side elevational view of the closure in the open state of FIG. 1.
Figure 4:
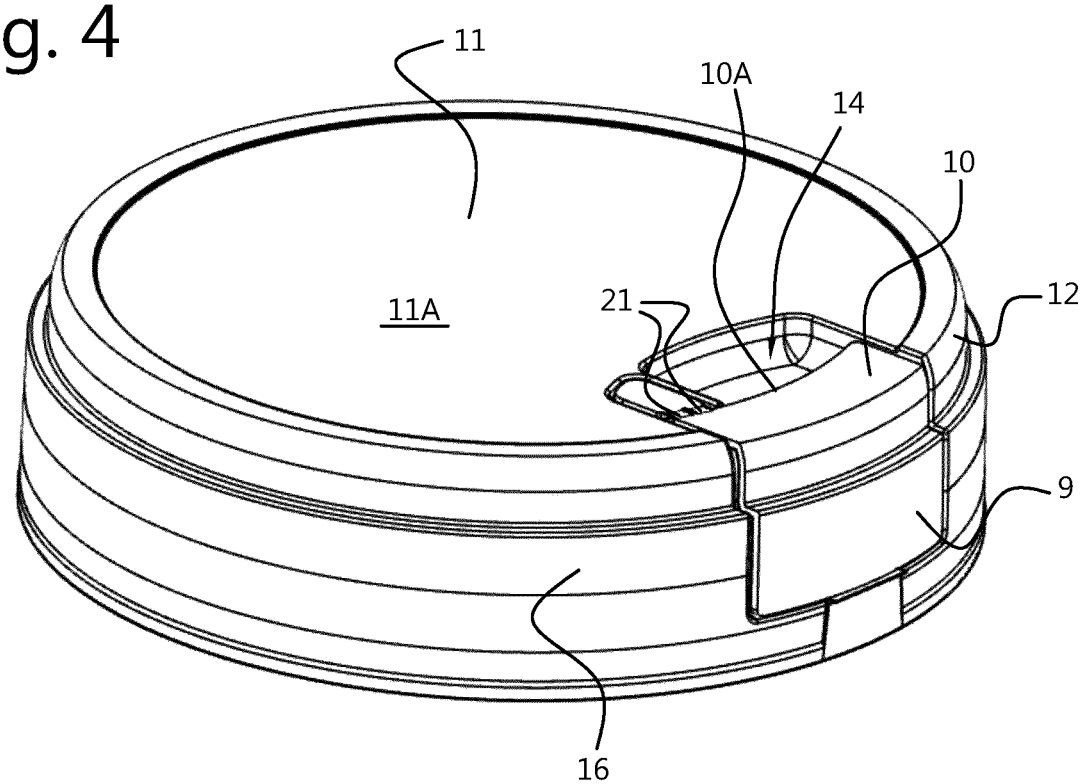
FIG. 4 shows a view in perspective of the closure of FIG. 1 in a closed state.

In FIGS. 1 and 2 is shown a closure 1 comprising an annular base 2 to be fixed to the upper rim of a container and defining an access opening 4 to the container. The closure 1 further comprises a lid 3 connected by a hinge 5 to the annular base 2. The hinge 5 allows that the lid 3 can be moved between an open position as is shown in FIGS. 1 and 2, and a closed position which is shown in FIG. 4. In the closed position the lid 3 covers the access opening 4, In the open position the lid 3 unblocks the access opening 4.

Closures of this type are typically used on packaging containers containing a powdered or granular product, such as for example baby formula or powdered milk, but also product in the form of tablets. Such a container may have a cylindrical shape with a bottom and an open top and may be made of metal, plastic or another suitable material. It is noted that in the example shown in the figures the closure is round and suitable for assembly with a cylindrical container, but that also a more rectangular or square shape for example of the closure and the container can be used.

The closure 2 may be made by an injection moulding process from a suitable plastics material, e.g. PP or PE. The preferred embodiment shown in the figures is made entirely in one piece by injection moulding. Thus the annular base 2 and the lid 3 are made in one piece in one mould. A living hinge 5 connects the lid 3 and the annular base 2. In FIG. 1 a utensil 50 formed as a scoop is shown, which is placed in retention means 6 formed on the annular base 2. The utensil 50 is made separately from the closure 1.

On a side opposite the hinge 5 a locking tab 7 is integrally formed with the annular base 2. The locking tab 7 is connected to the annular base 2 by a hinge 8, which in this specific embodiment is a living hinge 8.

The lid 3 has an upper deck 11 as well as an outer skirt 12 and an inner skirt 13. In the upper deck an indent 14 is formed which lies recessed with respect to an upper surface 11A of the deck. As can be seen in FIG. 1 the indent 14 forms a protrusion with respect to the lower surface 11B of the deck 11.

The annular base 2 has a recessed portion 15, which is recessed with respect to the outer circumferential contour of the annular base 2. The recessed portion 15 is adapted to receive the locking tab 7.

Figure 5:
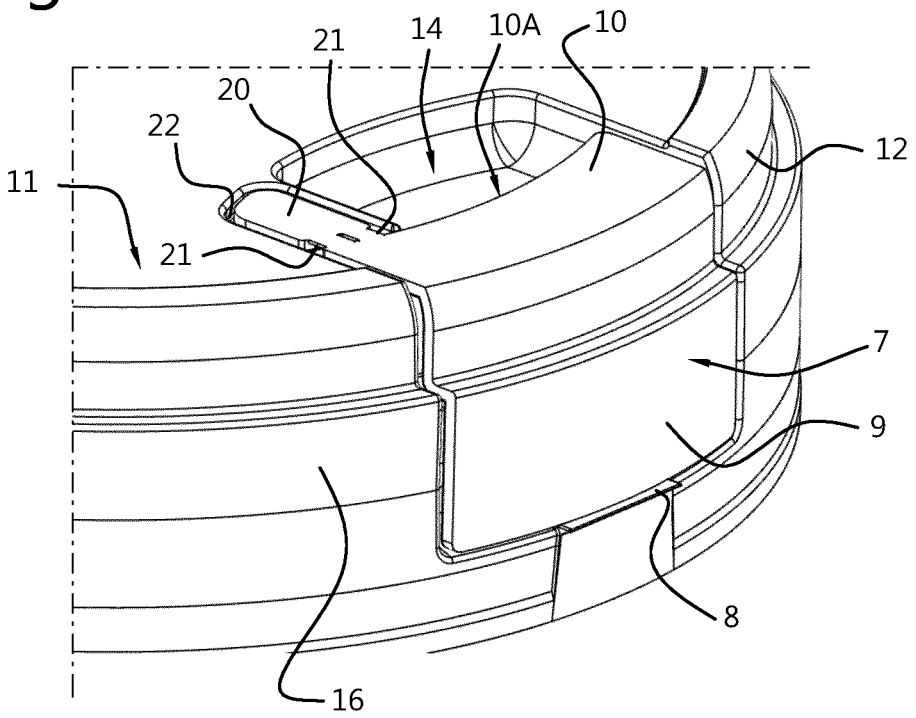
FIG. 5 shows in detail a locking tab of the closure as shown in FIG. 4.

The locking tab 7 has essentially two portions: a first portion 9, which in a locked state lies flush with the outer skirt 12 of the lid 3 and with an outer circumferential surface 16 of the annular base 2, as can be seen in FIGS. 4 and 5, and a second portion 10 which in the locked state lies flush with the upper deck surface 11A, as can be seen in FIGS. 4 and 5. The second portion 10 extends substantially perpendicular with respect to the first portion 9 and in a locked state (cf. FIGS. 4 and 5) overlies an edge portion of the lid 3 to retain the lid 3 in a closed position. The locking tab 7 thus has basically a hook shape. The second portion 10 of the tab 7 is provided with a latch member 17, which engages in the locking position a front edge of the indent 14, which is configured as a latching rim. Thereby a snap connection is formed, which in the locked position (cf. FIGS. 4 and 5) connects the locking tab 7 with the lid 3 in a releasable manner. The indent 14 in the lid 2 is dimensioned such that a finger can be inserted and a gripping edge 10A of the second portion 10 of the locking tab 7 can be engaged so as to release the snap connection between the locking tab 7 and the latching rim of the lid 3.

Figure 8:
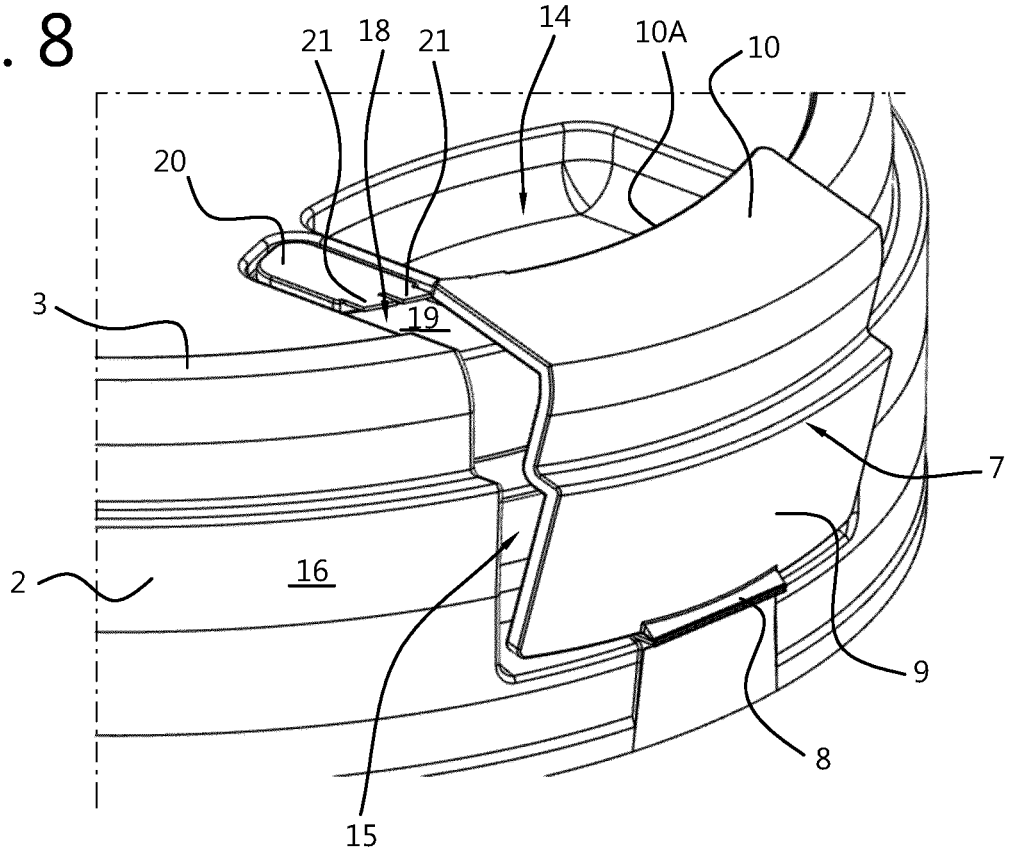
FIG. 8 shows in detail the locking tab of the closure in the state shown in FIG. 7.

Adjacent to the indent 14 a recessed area 18 is formed which includes an attachment surface 19 of the lid 3. This is best seen in FIG. 8.

Figure 3:
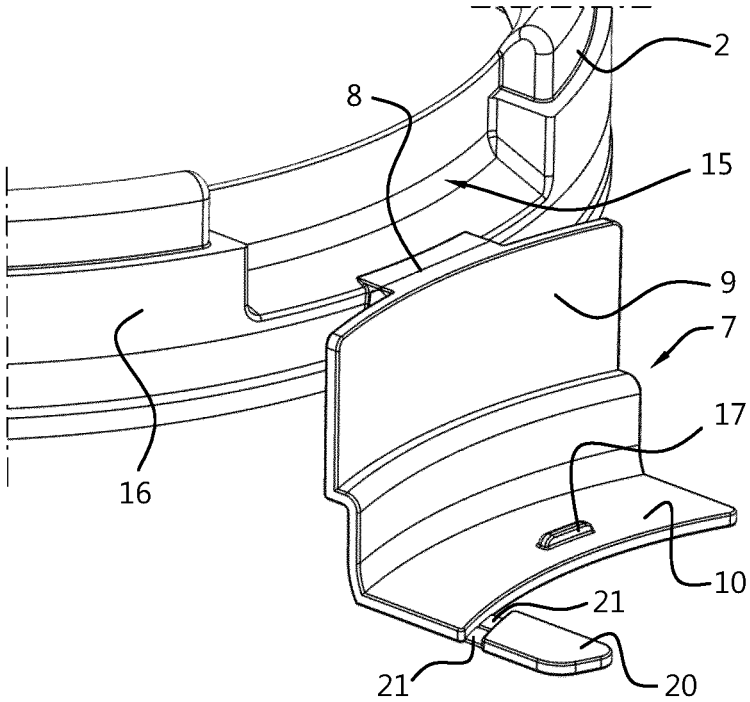
FIG. 3 shows in detail a locking tab of the closure as is shown in FIG. 1.

A tamper-evident lug 20 is formed on the edge 10A of the second portion 10 of the locking tab 7 as can be best seen in FIG. 3. The tamper evident lug 20 is formed as a protruding lip. It has a similar wall thickness as the second portion 10 of the locking tab 7, although this is not necessary. The tamper-evident lug 20 is connected to the second portion 10 of the locking tab 7 by frangible connection portions 21 which have a substantially smaller thickness than the wall thickness of the second portion 10 and the tamper-evident lug 20.

The locking tab 7 and the tamper-evident lug 20 interconnected by the frangible connection(s) 21 constitute in this embodiment a locking member that prevents movement of the lid 3 with respect to the annular base 2.

The tamper-evident lug 20 is received in the recessed area 18 of the lid 3, such that the tamper-evident lug 20 in the locked state (cf. FIGS. 4 and 5) lies flush with the upper deck surface 11A. The recessed area 18 and the tamper-evident lug 20 have a corresponding contour and the tamper-evident lug 20 is only slightly smaller than the recessed area such that only a small gap 22 remains between the tamper-evident lug 20 and the contour of the recessed area as can be seen in FIG. 5. Thereby the tamper-evident lug 20 cannot be reached by a finger or a tool when it is received in the recessed area 18.

Figure 6:
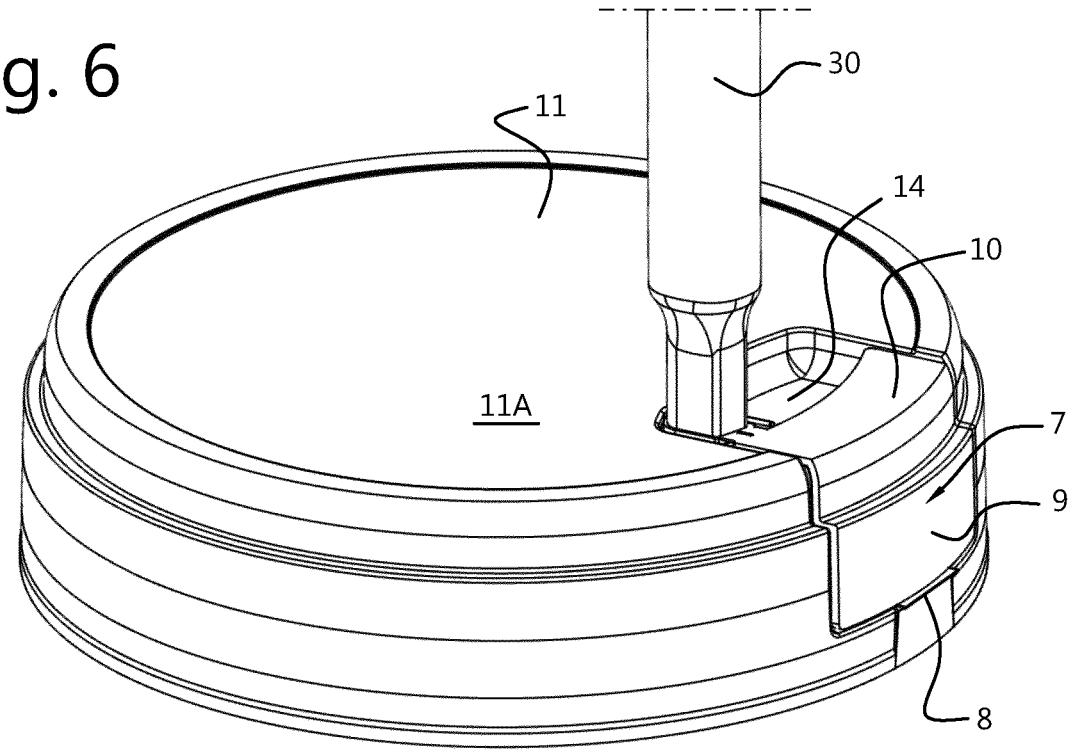
FIG. 6 illustrates the ultrasonic welding of a tamper-evident lug of the locking tab of the closure as is shown in FIG. 4.
Figure 7:
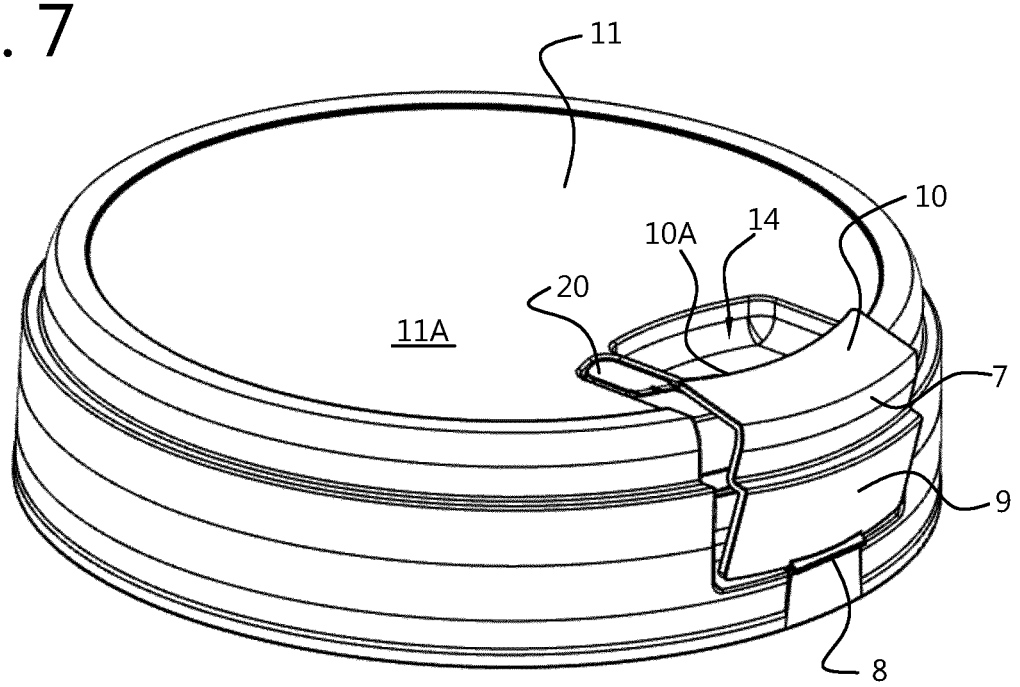
FIG. 7 illustrates the first time opening of the closure of FIG. 4.

The tamper-evident lug 20 is bonded to the attachment surface 19. This is preferably done by ultrasonic welding which is illustrated in FIG. 6. In FIG. 6 a sonotrode 30 is shown which is brought in contact with the upper side of the tamper-evident lug 20 after which ultrasonic energy is emitted in the plastic material of the tamper-evident lug 20 and the attachment surface 19. Thereby the tamper-evident lug 20 is permanently bonded to the attachment surface 19. The locking tab 7 can now only be brought to an unlocked state by pulling the second portion 10 of the tab 7 upwards and rupturing or breaking the frangible connection portions 21 as is illustrated in FIGS. 7 and 8. Thus, after first-time releasing of the locking tab 7, a person can readily assess that the locking tab 7 has been released before, and the package has possibly been tampered with, by inspecting the integrity of the connection portions 21.

It is noted that the tamper-evident lug 20 is preferably welded to the attachment surface 19 by means of ultrasonic welding because of its easy application. It should be understood however that also other ways to fixedly attach the tamper-evident lug 20 to the attachment surface are encompassed by the claimed invention. The attachment may for example be achieved by other types of welding.

Embodiments wherein the tamper-evident lug is attached to the lid by bonding through an adhesive or by mechanical attachment, e.g. a snap connection between the tamper-evident lug and the attachment surface are possible although such embodiments do not have the preference at this moment due to a more complex design.

As mentioned before, the closure 1 is preferably made in one piece. It is ejected from the injection mould in an open state that is shown in FIG. 1. If desired a utensil 50 may be placed in the annular base as is shown in FIG. 1. Next, the lid 3 may be closed after which the locking tab 7 is hinged from the position shown in FIGS. 1-3 to the locking position as is shown in FIG. 5, in which the snap connection between the lid 3 and the locking tab 7 is realised. Next, the tamper-evident arrangement can be made by welding the tamper-evident lug 20 to the lid 3 as illustrated in FIG. 6, such that the locking tab 7 can only be released by breaking the frangible connection between the tamper-evident lug 20 and the locking tab 7, which is illustrated in FIGS. 7 and 8.

Figure 9:
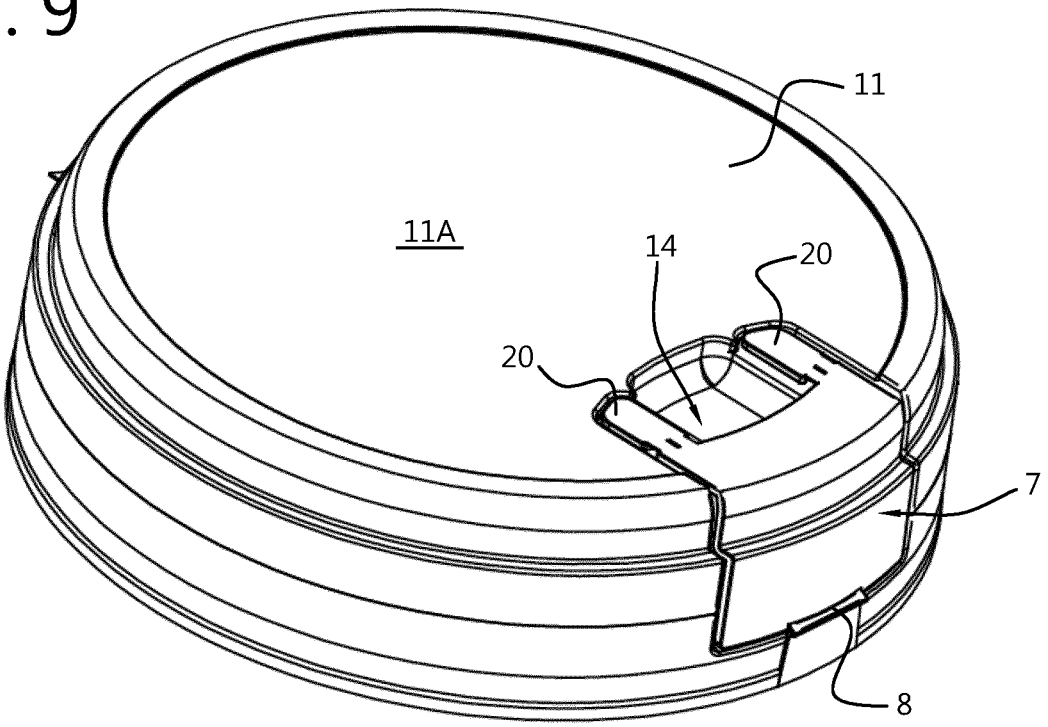
FIG. 9 shows a view in perspective of another embodiment of a closure according to the invention in a closed state.
Figure 10:
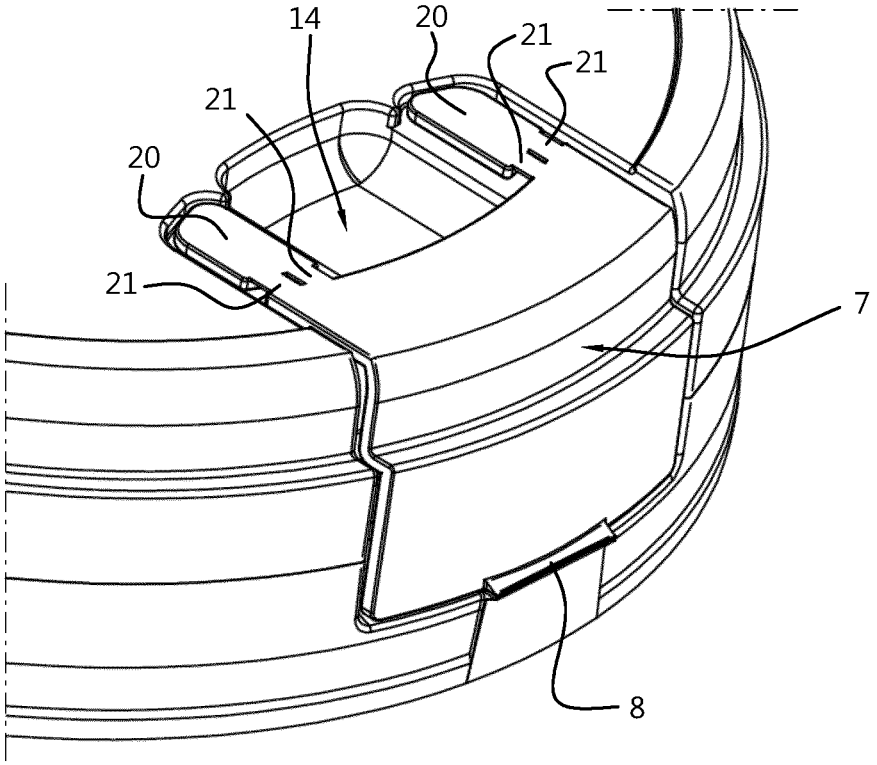
FIG. 10 shows a detail shows in detail a locking tab of the closure as shown in FIG. 9.

In FIGS. 9 and 10 a similar embodiment as the one of the FIGS. 1-8 is shown. Therefore the same reference numerals are used for the same components and for a description is referred to the above description. This particular embodiment of FIGS. 9 and 10 has two tamper-evident lugs 20, which make the structure of the locking tab with the tamper-evident lugs of a symmetrical design.

It should be understood that the invention not only encompasses one-piece closures of which the annular base and the lid are integrally connected by a living hinge. It is conceivable to separately manufacture the lid and the annular base and assemble the lid and the base by means of a hinge structure. The same is valid for the annular base and the locking tab. Also the annular base and the locking tab may be manufactured separately and then assembled by means of a hinge structure.

The embodiments of the invention shown in the FIGS. 1-10 may be summarised by the following clauses:

1. Closure (1) for a container, wherein said container has an open top side defined by an upper rim surrounding said open top side, the closure (1) comprising an annular base (2) to be fixed to the upper rim of the container and defining an access opening to the container, and the closure (1) further comprising a lid (3) connected by a hinge (5) to the annular base (2) such that the lid (3) can be moved between a closed position, in which the lid (3) covers the access opening, and an open position, in which the access opening is unblocked by the lid (3), wherein a locking tab (7) is hingedly connected to the base (2), and wherein the locking tab (7) and the lid (3) are adapted to form a releasable snap connection so as to lock the lid (3) relative to the base (2) in a locked state, wherein at least one tamper-evident lug (20) is integrally formed with the locking tab (7) wherein a frangible connection (21) is formed between the locking tab (7) and the tamper-evident lug (20), wherein the tamper-evident lug (20) is fixedly attached to an attachment surface (19) of the lid (3).

2. Closure according to clause 1, wherein the tamper-evident lug (20) is bonded to the attachment surface (19) of the lid (3).

3. Closure according to clause 1 or 2, wherein the tamper-evident lug (20) is welded to the attachment surface (19) of the lid (3), preferably by ultrasonic welding.

4. Closure according to any of the preceding clauses, wherein the locking tab (7) has a latch member (17) which engages behind a latching rim of the lid (3).

5. Closure according to any of the preceding clauses, wherein the lid (3) has a deck (11) and an outer skirt (12) depending from the deck (11), the deck (11) including an indent (14) which is recessed with respect to an upper deck surface (11A), wherein the indent (14) is adapted to provide space for a finger to engage the locking tab (7) so as to release the snap connection.

6. Closure according to clause 5, wherein the indent (14) is adjacent to the attachment surface (19) of the lid (3).

7. Closure according to clause 5 or 6, wherein the locking tab (20) has a first portion (9), which in the locked state lies flush with the outer skirt (12) of the lid (3) and with an outer circumferential surface of the annular base (2), and wherein the locking tab (20) has a second portion (10) which in the locked state lies flush with the upper deck surface (11A).

8. Closure according to any of the clause 5-7, wherein the deck (11) of the lid (3) has a recessed area (18) to receive the tamper-evident lug (20) such that the tamper-evident lug (20) in the locked state lies flush with the upper deck surface (11A), the recessed area (18) having a contour corresponding with an outer contour of the tamper evident lug (20).

9. Closure according to any of the clauses 5-8, wherein the second portion (10) of the locking tab (7) has a gripping edge (10A) which in the locked state is facing the indent (14), wherein the frangible connection (21) between the locking tab (7) and the tamper-evident lug (20) is in line with said gripping edge (10A).

10. Closure according to any of the preceding clauses, wherein the annular base (2), the lid (3) and the locking tab (7) are formed in one piece by injection moulding.

11. Method for manufacturing a closure (1) according to any of the preceding clauses, wherein the annular base (2), the lid (3) and the locking tab (7) with the tamper-evident lug (20) are each injection moulded from a plastic material, wherein, after injection moulding, the lid (3) is positioned in a closed state on the annular base (2) and the locking tab (7) is positioned in a locked state, such that the tamper-evident lug 20 faces the attachment surface (19), and wherein the tamper-evident lug (20) is engaged by an ultrasonic welding tool (30) and welded to the attachment surface (19).

12. Method according to clause 11, wherein the annular base (2), the lid (3) and the locking tab (7) are injection moulded in one piece.

Figure 11:
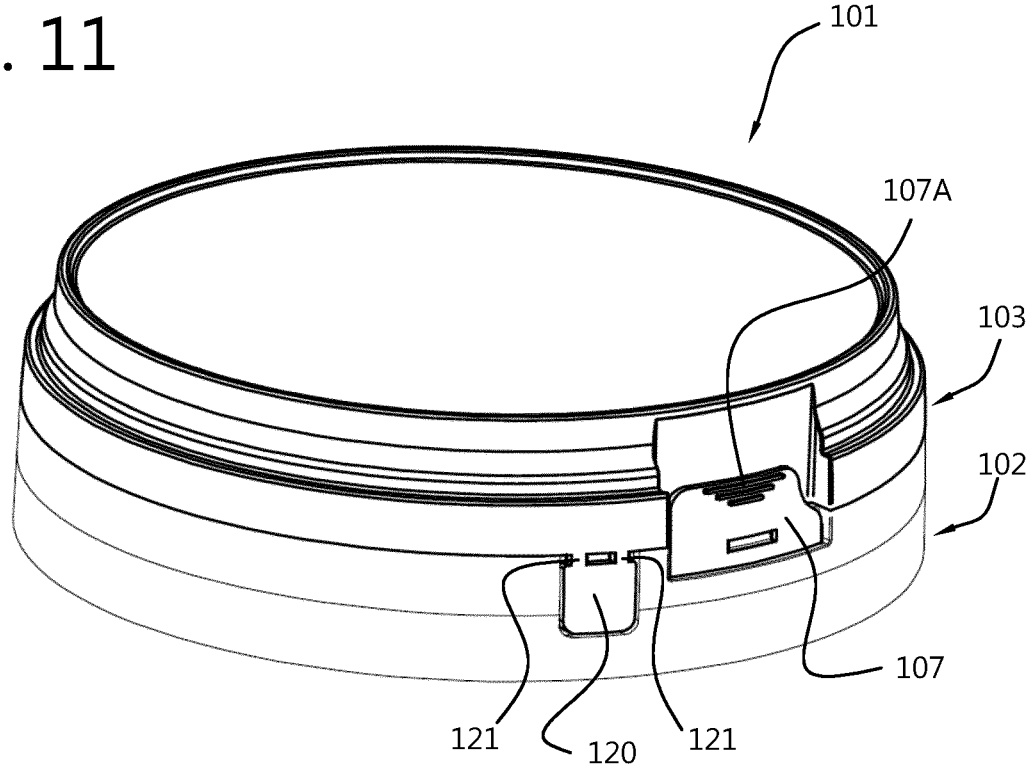
FIG. 11 shows a view in perspective of another embodiment of a closure according to the invention in a closed state.
Figure 12:
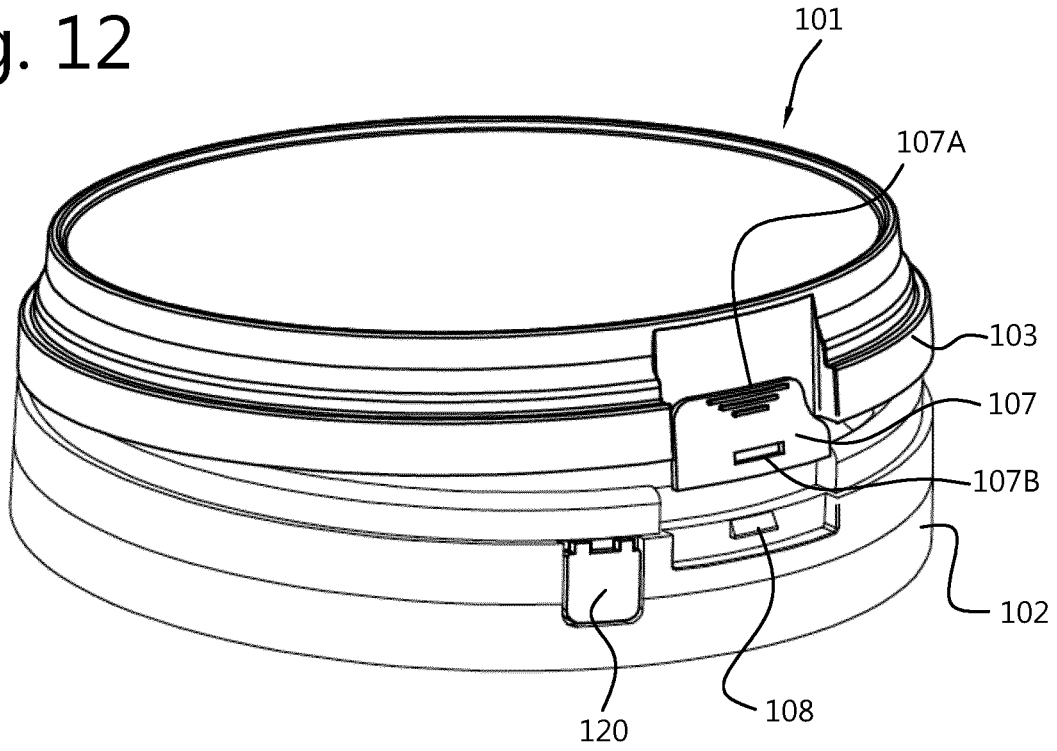
FIG. 12 shows a view in perspective of the closure of FIG. 11 during opening of the closure.

In FIG. 11 is shown another embodiment of a closure according to the invention. In this embodiment the closure 101 comprises an annular base 102 to be fixed to the upper rim of the container and defining an access opening to the container. The closure 101 furthermore comprises a lid 103 adapted to cover the access opening in a closed position. In this case the lid 103 is connected to the annular base 102 by a hinge which is not visible in FIGS. 11 and 12, but which is comparable to the hinge shown in FIGS. 1 and 2. The lid 103 can be hinged to an open position, in which the access opening is accessible.

This embodiment comprises a tamper-evident lug 120 connected to the lid 103 by one or more frangible connections 121. The tamper-evident lug 120 and the frangible connections 121 constitute in this embodiment a locking member which is integrally (in one piece) formed with the lid 103. The tamper evident lug 120, after first time closing of the closure is welded to an attachment surface of the annular base 102.

In this embodiment a latching button 107 is formed on the lid 103, which has a latching aperture 107B adapted to engage with a latching member 108 on the annular base 102 to form a snap connection and thereby to lock the lid 103 in a locked position after first time opening of the closure, when the one or more frangible connections 121 are broken. The snap connection can be released by pushing the button at 107A, whereby the button tilts and the latching aperture 107B and the latching member 108 are disengaged.

Upon first time opening the latching button is operated and disengaged from the latching member 108. By pulling the lid 103 up the frangible connection(s) 121 are broken and the tamper-evident lug 120 remains attached to the annular base 103.

The invention claimed is:

1. A closure for a container, wherein said container has an open top side defined by an upper rim surrounding said open top side, the closure comprising:

an annular base to be fixed to the upper rim of the container and defining an access opening to the container, a lid adapted to cover the access opening in a closed position, the lid adapted to be moved to an open position, in which the access opening is unblocked by the lid, and the lid having an attachment surface, a locking member attached to the base and to the lid so as to lock the lid relative to the base such that movement of the lid relative to the annular base is prevented, wherein the locking member comprises a locking tab and at least one tamper-evident lug, the locking tab being connected to the annular base and being adapted to form a releasable snap connection with the lid so as to lock the lid relative to the annular base in a locked state, and the tamper-evident lug being integrally formed with the locking tab, wherein said frangible connection is formed between the locking tab and the tamper-evident lug, and wherein the tamper-evident lug is welded to the attachment surface of the lid.

2. The closure according to claim 1, wherein the tamper-evident lug is welded to the attachment surface by ultrasonic welding.

3. The closure according to claim 1, wherein the lid is attached to the annular base by a hinge such that the lid can be pivotally moved between a closed position, in which the lid covers the access opening, and an open position, in which the access opening is unblocked by the lid.

4. The closure according to claim 1, wherein the locking tab is integrally formed with the annular base.

5. The closure according to claim 1, wherein the locking tab is hingedly connected to the annular base.

6. The closure according to claim 1, wherein the locking tab has a latch member which engages behind a latching rim of the lid to form the snap connection.

7. The closure according to claim 6 wherein the lid has a deck and an outer skirt depending from the deck, the deck having an upper deck surface and including an indent which is recessed with respect to the upper deck surface, wherein the indent is adapted to provide space for a finger to engage the locking tab so as to release the snap connection.

8. The closure according to claim 7, wherein the indent is adjacent to the attachment surface of the lid.

9. The closure according to claim 7, wherein the locking tab has a first portion, which in the locked state lies along the outer skirt of the lid and along an outer circumferential surface of the annular base, and wherein the locking tab has a second portion which in the locked state lies along the upper deck surface.

10. The closure according to claim 7, wherein the deck of the lid has a recessed area to receive the tamper-evident lug.

11. The closure according to claim 10, wherein the recessed area is configured such that the tamper-evident lug in the locked state lies flush with the upper deck surface.

12. The closure according to claim 11, wherein the recessed area has a contour corresponding with an outer contour of the tamper evident lug.

13. The closure according to claim 9, wherein the second portion of the locking tab has a gripping edge which in the locked state is facing the indent, wherein the frangible connection between the locking tab and the tamper-evident lug is in line with said gripping edge.

14. The closure according to claim 1, wherein the annular base, the lid and the locking tab are formed in one piece by injection moulding.

15. A closure for a container, wherein said container has an open top side defined by an upper rim surrounding said open top side, the closure comprising:

an annular base to be fixed to the upper rim of the container and defining an access opening to the container, and the annual base having an attachment surface, a lid adapted to cover the access opening in a closed position, the lid adapted to be moved to an open position, in which the access opening is unblocked by the lid, a locking member attached to the base and to the lid so as to lock the lid relative to the base such that movement of the lid relative to the annular base is prevented, the locking tab being connected to the lid and being adapted to form a releasable snap connection with the annular base so as to lock the lid relative to the annular base in a locked state, and the tamper-evident lug being integrally formed with the locking tab, wherein a frangible connection is formed between the locking tab and the tamper-evident lug, and wherein the tamper-evident lug is welded to the attachment surface of the annular base.

16. The closure according to claim 15, wherein the tamper-evident lug is welded to the attachment surface by ultrasonic welding.

17. The closure according to claim 15, wherein the lid is attached to the annular base by a hinge such that the lid can be pivotally moved between a closed position, in which the lid covers the access opening, and an open position, in which the access opening is unblocked by the lid.

18. The closure according to claim 15, wherein the locking tab is integrally formed with the lid.

19. The closure according to claim 15, wherein the locking tab is hingedly connected to the lid.

20. The closure according to claim 15, wherein the locking tab has a latch member which engages behind a latching rim of the annular base to form the snap connection.

21. The closure according to claim 15, wherein the annular base, the lid and the locking member are formed in one piece by injection moulding.

22. A closure for a container, wherein said container has an open top side defined by an upper rim surrounding said open top side, the closure comprising:

an annular base to be fixed to the upper rim of the container and defining an access opening to the container, a lid adapted to cover the access opening in a closed position, the lid adapted to be moved to an open position, in which the access opening is unblocked by the lid, and the lid having an attachment surface, the lid having a deck and an outer skirt depending from the deck, the deck having an upper deck surface, a locking member attached to the annular base and to the lid so as to lock the lid relative to the annular base such that movement of the lid relative to the annular base is prevented, wherein the locking member comprises a locking tab and at least one tamper-evident lug, the locking tab being connected to the annular base and being adapted to form a releasable snap connection with the lid so as to lock the lid relative to the annular base in a locked state, the locking tab having a first portion, which in the locked state lies along the outer skirt of the lid and along an outer circumferential surface of the annular base, and the locking tab having a second portion which in the locked state lies along the upper deck surface, and the tamper-evident lug being integrally formed with the locking tab, wherein a frangible connection is formed between the second portion of the locking tab and the tamper-evident lug, and wherein the tamper-evident lug is welded to the attachment surface of the lid.

23. The closure according to claim 22, wherein the deck of the lid has a recessed area to receive the tamper-evident lug.

24. The closure according to claim 23, wherein the recessed area is configured such that the tamper-evident lug in the locked state lies flush with the upper deck surface.

25. The closure according to claim 23, wherein the recessed area has a contour corresponding with an outer contour of the tamper evident lug.

* * * * *